United States Patent [19]

Smith et al.

[11] Patent Number: 4,690,747

[45] Date of Patent: Sep. 1, 1987

[54] SELECTIVE PLATING APPARATUS

[75] Inventors: Mark L. Smith; Richard M. Wagner, both of Harrisburg, Pa.

[73] Assignee: AMP Incorporated, Harrisburg, Pa.

[21] Appl. No.: 946,467

[22] Filed: Dec. 23, 1986

[51] Int. Cl.[4] ..... C25D 5/02; C25D 17/00

[52] U.S. Cl. ..... 204/206; 204/15; 204/26; 204/224 R; 204/225

[58] Field of Search ..... 204/206, 15, 26, 224 R, 204/225

[56] References Cited

U.S. PATENT DOCUMENTS

| | | | |
|---|---|---|---|
| 2,503,863 | 4/1950 | Bart | 204/225 |
| 3,410,781 | 11/1968 | Carlson et al. | 204/225 |
| 3,951,761 | 4/1976 | Böhringer | 204/15 |
| 4,340,449 | 7/1982 | Srinivasan et al. | 204/224 R |
| 4,364,801 | 12/1982 | Salama | 204/224 R |
| 4,384,926 | 5/1983 | Wagner | 204/26 |
| 4,405,432 | 9/1983 | Kosowsky | 204/206 |
| 4,427,498 | 1/1984 | Wagner | 204/26 |
| 4,555,321 | 11/1985 | Wicks | 204/26 |
| 4,564,430 | 1/1986 | Bacon et al. | 204/224 R |
| 4,605,834 | 8/1986 | Inoue | 204/206 |

*Primary Examiner*—Arthur P. Demers
*Attorney, Agent, or Firm*—Katherine A. Nelson

[57] ABSTRACT

An apparatus for plating interior surfaces of electrical terminals that are attached to a carrier strip comprises a mandrel having first and second portions, the first portion being comprised of dielectric members which are mounted for rotation on a shaft as strip fed terminals are continuously fed to the first portion; wrapped against it and exited therefrom; and a second conductive portion mounted in a stationary portion on the same shaft. First dielectric portion includes a plurality of nozzles distributed about its axis of rotation. A plurality of anode members are mounted within the nozzles, the anode members being movable into and out of interiors of terminals that are wrapped against the dielectric portion. A conduit supplies plating solution under pressure through the nozzles and upon anode members. A source of electrical potential supplies electrical current flow from anode members through plating solution and into interiors of terminals thus forming a plurality of plating cells about the dielectric portion. The apparatus includes means for assuring electrical engagement between the anode assemblies and the conductive portion so that an essentially uniform current is suppled to each plating cell. The apparatus further includes camming means which cooperates with a camming engagement member on each anode assembly to ensure retraction of each assembly from its corresponding terminal.

18 Claims, 7 Drawing Figures

SELECTIVE PLATING APPARATUS

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from metal strip and are attached to a carrier strip. This carrier strip is useful for strip feeding the terminals through successive manufacturing operations. One necessary manufacturing operation involves plating, i.e., electroplating the electrical contact surfaces of the noble metal alloys. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the terminals. The metal ions deposit as metal plating on those terminal surfaces in contact with the plating solution.

There are disclosed in U.S. Pat. Nos. 4,384,926, 4,427,498 and 4,555,321, owned by this Assignee, plating apparatuses as in which the interior surfaces of strip fed terminals can be plated by supplying plating fluid through nozzles and over associated anode extensions that are mounted for reciprocation into and out of the interiors of terminals. In the first two patents, the anode extensions are mounted within their associated nozzles. In the third patent, the anode extensions are mounted separately and apart from the nozzles and enter the terminals from a different direction than that of the plating fluid.

The apparatuses disclosed in the three referenced patents are designed to be used with stamped and formed terminals, wherein the contact zone is located inside the formed terminal. Each apparatus is comprised of an assembly of conductive and dielectric parts, all mounted for rotation on a stationary axis. Each of the apparatuses consists generally of a mandrel that is continuously rotated as strip fed electrical terminals are continuously fed to the mandrel, partially wrapped against it and exited from it. The mandrel is turreted with a plurality of nozzles distributed about its axis of rotation. Anodes are associated with the nozzles and are mounted for movement into and out of the interiors of the terminals that are against the mandrel. A conduit supplies plating solution under pressure through the nozzles and upon the anodes. The nozzles inject plating solution into the interiors of the terminals in which the anodes are received. A source of electrical potential supplies an electrical current flow from the anodes, through the plating solution and into the interiors of the terminals in which the anodes are received. In essence, each mandrel has a plurality of plating cells distributed about its axis of rotation.

Anode members or anode extensions are mounted within the assembly such that they can be moved into and out of the contact zone inside a formed terminal. The conductive anode members are either continually in mechanical engagement and electrical contact with or brought into electrical contact with an electrically charged member just prior to moving the anode member inside the terminal to selectively plate the contact zone. Generally the anode members are held against the charged member under tension by using either a spring in the anode extension member itself or by spring loading the anode extension members against a conductive plate of the apparatus or both. The anode members are then moved into and out of aligned terminal members by hydraulic, mechanical or a combination of means.

When plating electrical terminals in such an apparatus, it is important that an essentially uniform current be maintained in each of the individual plating cells which are distributed around the apparatus. The continual flexing movement of the spring portions owing to repeatedly engaging and disengaging terminals, friction between moving parts and exposure to corrosive chemicals can gradually affect the mechanical engagement between the anode member and the anode plate such that the current level within the cells is no longer uniform because one or more of the anode members are not functioning as intended. It is desirable, therefore, to provide an assured electrical interconnection that is not affected by mechanical factors such as those described above.

To achieve plating deposit in the desired area, it is also important that the anode members are moved into complete engagement with the associated terminal. In addition it is important that the anode members be removed completely from the terminal to prevent damage to either the anode member, the terminal or both as the terminal exits the apparatus. It is desirable, therefore, to provide a positive means to assure proper movement of the anode members.

SUMMARY OF THE INVENTION

The present invention described below is directed to an improved selective plating apparatus which has means for assuring an essentially uniform current to each of the cells of a plating apparatus. In the preferred embodiment the invention is designed to be used with anode assemblies of the type disclosed in copending U.S. Ser. No. 946,401 entitled *Anode Assembly for Selectively Plating Electrical Terminals,* filed concomitantly herewith and incorporated by reference herein. It is to be understood that other types of anode assemblies may also be used.

The apparatus is comprised of a mandrel having first and second portions, the first section being dielectric and mounted for rotation on a stationary conductive shaft as strip fed terminals are continuously fed to the first portion, wrapped against the first portion and exited therefrom. The first portion includes a plurality of nozzles distributed throughout its axis of rotation and a plurality of anode members mounted within the nozzles, the anode members being movable into and out of the interiors of the terminals that are against the dielectric first portion, the second portion being conductive and mounted in a stationary position on a conductive shaft. The apparatus further includes a conduit supplying plating solution under pressure through the nozzles and upon the anode members and a source of electrical potential for supplying electrical current from the anode members through the plating solution into the interior of the terminals. The apparatus has essentially a plurality of plating cells within the first mandrel portion.

The preferred embodiment of the apparatus also includes means for providing an essentially uniform current to each of the plating cells. The means comprises a conductor member having one end electrically engaged and mechanically secured to a conductive portion of each anode assembly member, conductive means secured circumferentially around a forward portion of the dielectric rotating first mandrel portion proximate the conductive second mandrel portion. The conductive means includes a plurality of conductor member terminating apertures in which are disposed the other end of the conductor members that are attached to the anode assemblies. Spring tab means are also included for electrically coupling the conductive second mandrel portion with said conductive means on said first mandrel portion such that the conductive means on the first mandrel portion may rotate while remaining in electrical engagement with the stationary conductive second mandrel portion.

The apparatus further includes a camming means to positively retract and move the anode assembly into engagement with the terminal. The means is a camming track formed in the stationary second mandrel portion by cooperating surfaces of a conductive cam plate and a conductive cam plate cover. In the assembled apparatus a retraction pin on each anode assembly is located in the cam track such that the anodes are removed from the terminals as the apparatus rotates out of the plating zone by the cam plate exerting a forward force against the retraction pin. The anodes are moved into the terminals by action of the cam cover exerting a rearward force against the rounded end of the anode assemblies as the anode assemblies move into the plating zone.

In addition to the above features, it is also an object of this invention to provide an apparatus that allows ready maintenance and replacement of anode assemblies.

It is also an object of the invention to provide an assembly with a minimum of parts that are easy to maintain and require a minimum amount of down time.

It is an additional object of the invention to provide an apparatus which readily allows threading of the stock without extensive disassembly of the apparatus.

The invention itself, together with further objects and its attendant advantages, will be best understood by reference to the following detailed description, taken in conjunction with the accompanying drawings.

DETAILED DESCRIPTION OF THE DRAWINGS

Figure 1:
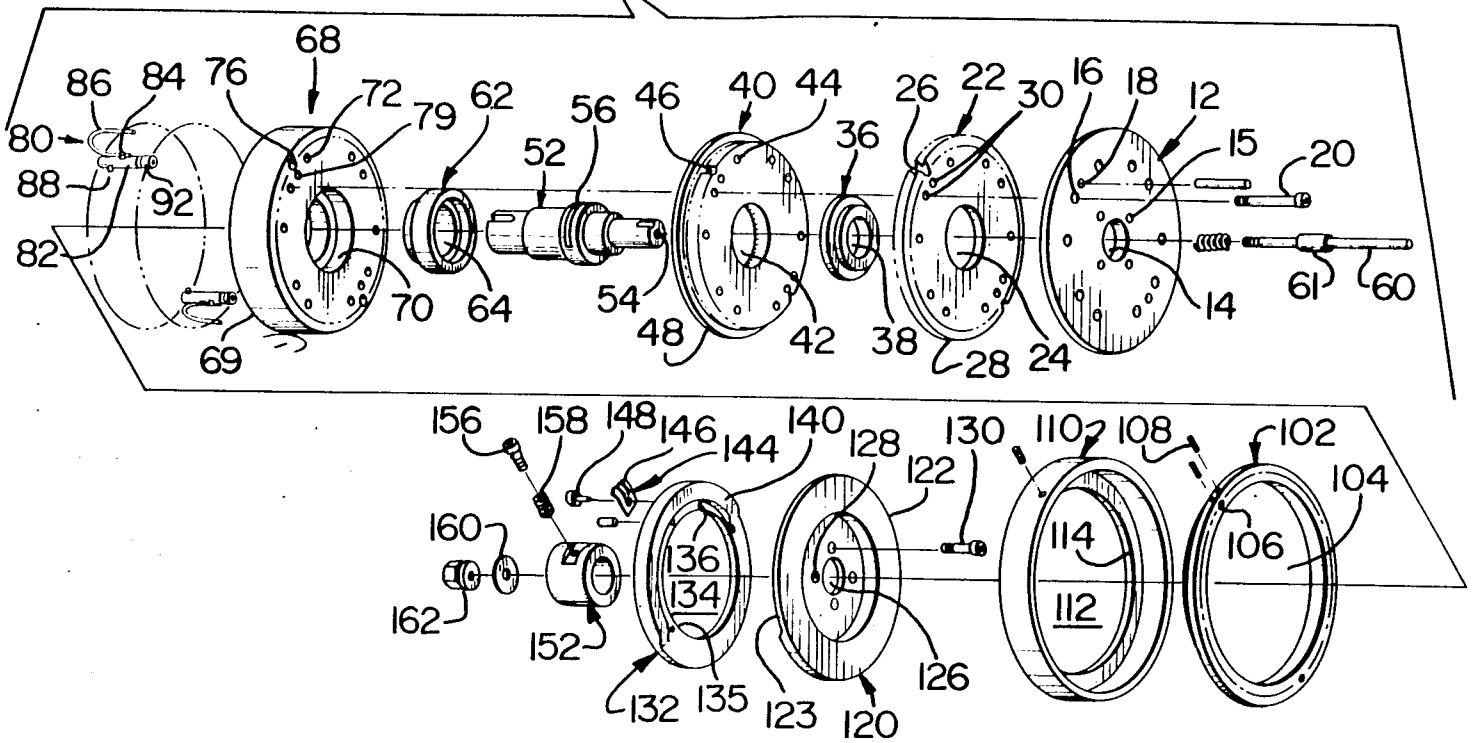
FIG. 1 is a perspective view of the apparatus for continuously plating the interior surfaces of electrical terminals according to the invention with parts of the apparatus exploded.
Figure 3:
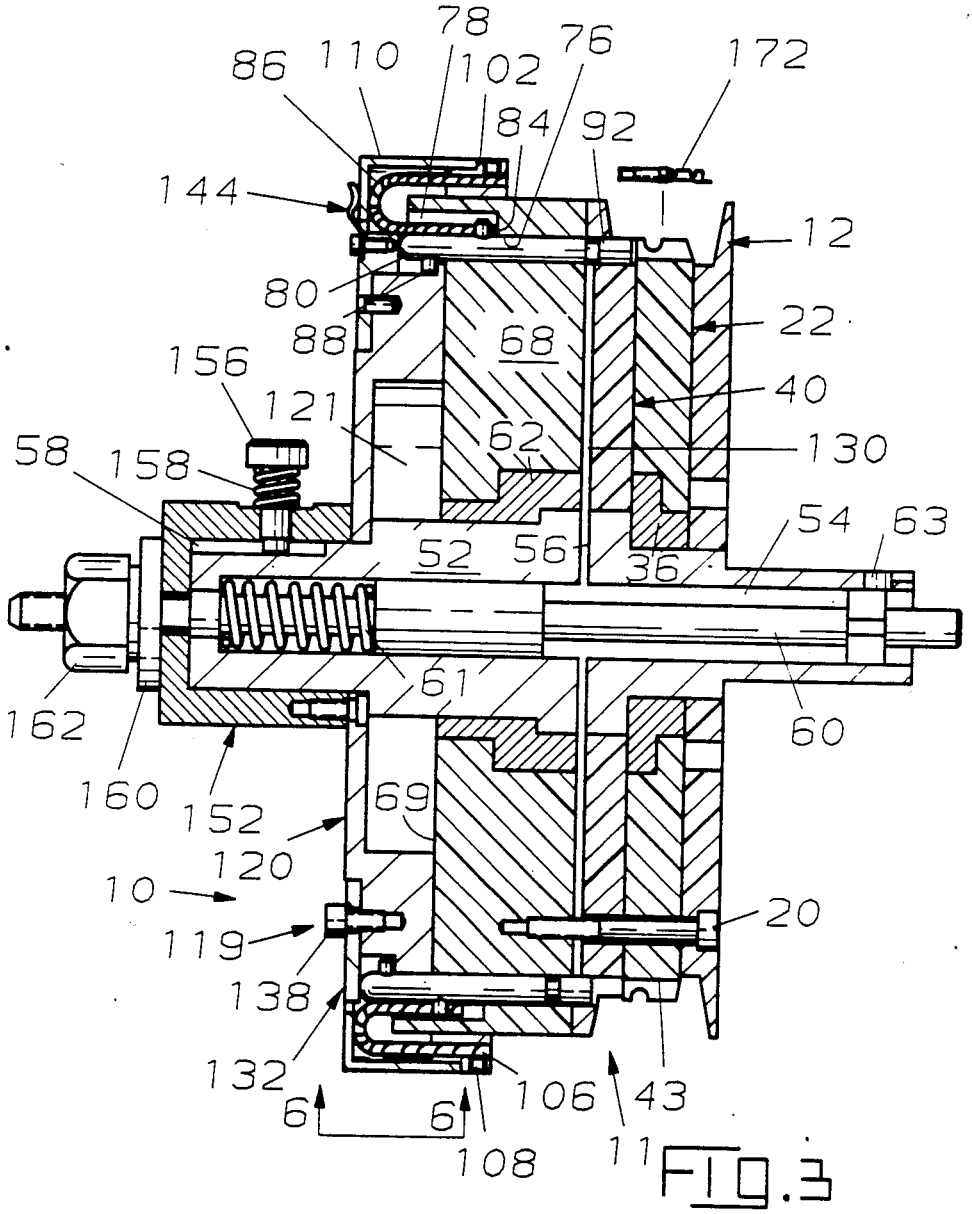
FIG. 3 is a cross-sectional view of the apparatus taken along lines 3—3 of FIG. 2.

FIGS. 1 and 3 illustrate details of plating apparatus 10 in accordance with the invention.

Apparatus 10 is comprised of two portions, a dielectric portion 11 and a conductive portion 119. The dielectric portion 11 is mounted for rotation on stationary conductive shaft 52 and comprises flange 12, the stock drive index plate 22, the nozzle and socket index plate 40, the cylinder manifold 68, and socket index and cylinder manifold bearings 36 and 62 respectively. Conductive portion 119 is mounted in stationary position on stationary conductive shaft 52 and is comprised of cam base 120 and cam plate cover 132 and collar member 152. In the preferred embodiment conductive wire collar 102 and conductive wire collar cover 110 are mounted circumferentially around cylinder manifold 68 and rotate with dielectric portion 11. The wire collar 102 and wire collar cover 110 provide a means for assuring electrical engagement for all the anodes of assemblies 80, apparatus 10 as will be explained in greater detail.

Shaft 52 is profiled to cooperate with the internal apertures of bearings 36, 62 and nozzle and socket index plate 40 such that the dielectric parts are interlocked around shaft 52 and are held in place by a plurality of bolts 20. The conductive parts are held on the forward shaft 52 by a washer and nut 160, 162 as best seen in FIG. 3.

Figure 2:
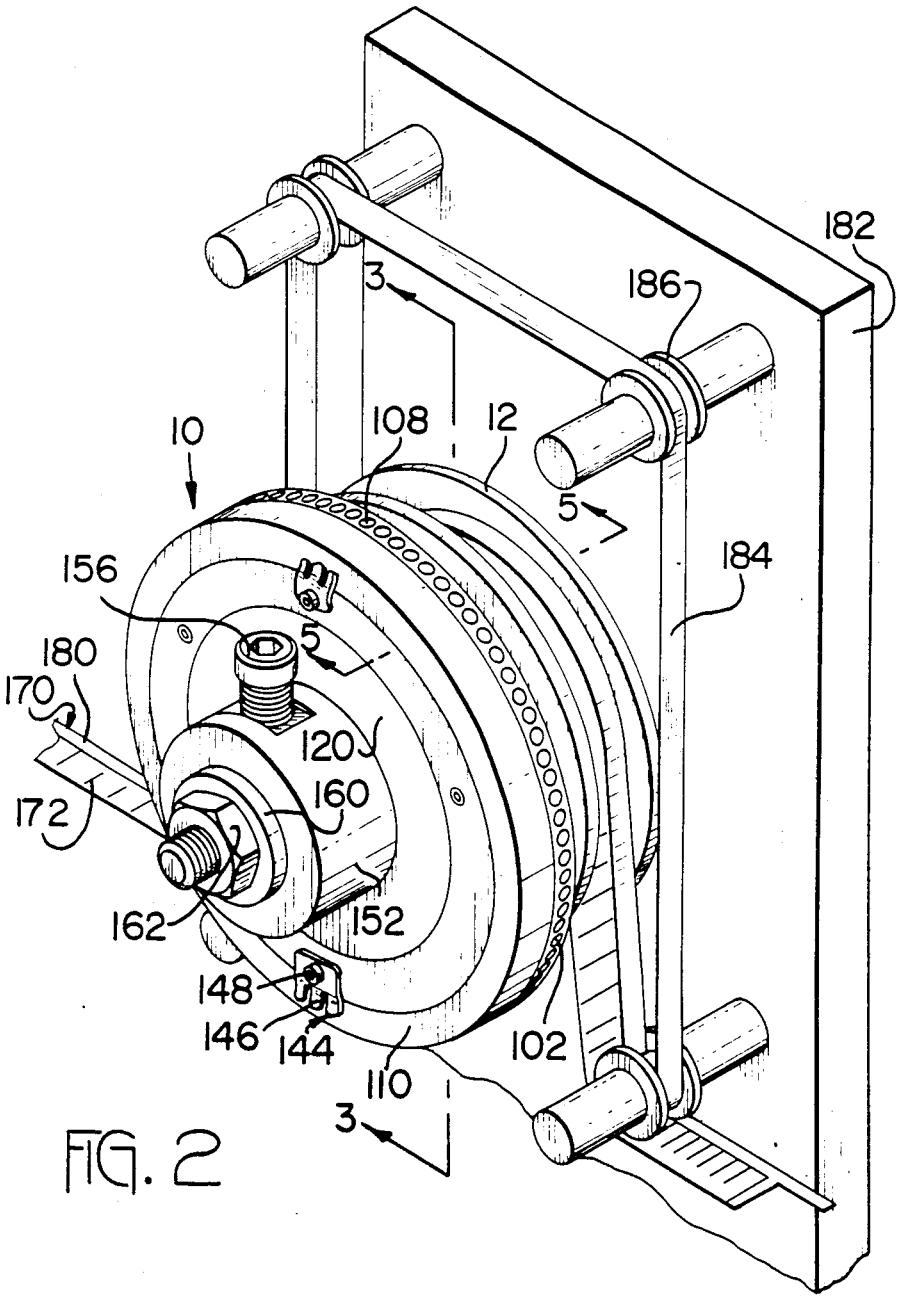
FIG. 2 is a perspective view of the assembled apparatus shown in FIG. 1 combined with a belt mechanism for feeding the strip of terminals.

As is shown in FIG. 2, assembled apparatus 10 is attached to mounting surface 182 such as a plating tank by attaching shaft 52 with mounting means (not shown) such that shaft 52 remains stationary during the plating process. As further shown in FIG. 2, terminal strip 170 is comprised of a plurality of terminals 172 integral with and serially spaced along carrier strip 180. Strip 170 is fed to the apparatus 10, partially wrapped against the apparatus 10 and fed from the apparatus 10. Strip 170 is held on the apparatus 10 by means of tension belt 184 which passes through a series of pulleys 186. Tension belt 184 holds the wrapped portion of strip 170 against the surface of the apparatus during the plating process.

Figure 5:
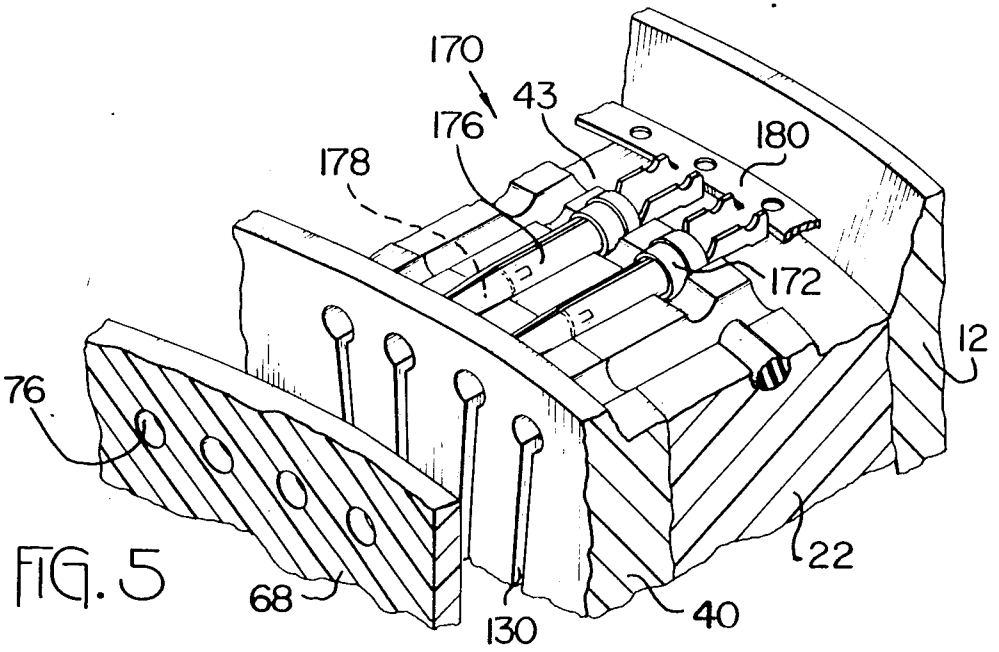
FIG. 5 is an enlarged fragmentary perspective view of a section of the apparatus taken along line 5—5 of FIG. 2.

For purposes of illustrating the invention, terminal strip 170 is comprised of a plurality of socket terminals 172 as shown in FIG. 5. Terminals 172, which are attached to carrier strip 130, are comprised of a socket portion 176 having a passageway 178 therein with a contact zone 180. The selectively plated layer is generally a noble metal or a noble metal alloy or a plurality of layers of such metals. A deposit of metal plated in accordance with the invention, has observable characteristics that distinguish it from characteristics of plating by other means known in the art. By using the apparatus of the present invention, it is possible to deposit plating thicknesses of 15 microinches and greater directly to the interior contact zone of the terminals as described in the prior art patents.

In the preferred embodiment dielectric parts 12, 22, 40 and 62 are advantageously machined from polyvinyldichloride (PVDC) polyphenylene sulfide, or the like. Bearings 36 and 68 are preferably made from high molecular weight polymers such as 1900$^R$ UHMW from Hercules, Incorporated, and other bearing materials as known in the art. Generally the dielectric materials should be thermally stable in the operation range of 130° to 140° F., be machineable, and be resistant to both alkaline and acid solutions generally in the pH from 3 to 12.

It is to be understood that ideally dielectric parts 12, 22, 140 and 162 could be formed as individual units with their respective portions of bearings 36 and 68. At present, however, most materials suitable for bearings are not sufficiently thermally stable to be useable as the dielectric parts and conversely materials that are sufficiently thermally stable and machineable do not perform well when used as bearings.

For durability, the conductive parts 52, 102, 110, 120, 132 and 152 are preferably made of stainless steel. The dielectric and conductive parts are assembled with bolts 20, 123 and 148 as will be described more fully below.

Insulative flange 12 has aperture 14 therein for mounting flange onto shaft 52, and a plurality of apertures 16 therein for receiving bolts 20 when the apparatus 10 is assembled. Flange 12 further has apertures 15 therein for engagement with driving means (not shown) and aperture 18 for receipt of an alignment pin 79 as described hereinafter. Insulative stock drive index plate 22 has aperture 24 therein for mounting to stock index bearing 36 and a plurality of V shaped notches 26 in circumferential surface 28 of said ring. Stock drive index plate 22 further has apertures 30 for receiving bolts 20 and aperture 31 for receiving alignment pin 79 when apparaus 10 is assembled. Stock index bearing 36 has aperture 38 therein for mounting to shaft 52. Stock bearing 36 being profiled to engage stock drive index plate 22. Insulated nozzle and socket index plate 40 has aperture 42 therein for mounting to shaft 52, a plurality of apertures 44 for receiving bolts 20 and aperture 45 for receiving alignment pin 79 when assembling the apparatus. Nozzle and socket index plate 40 further has a plurality of socket notches 46 on the circumferential surface 48 and a plurality of electrolyte passageways 130 on a face thereof as best seen in FIG. 3. Cylinder manifold 68 has aperture 70 therein for mounting to a cylinder manifold bearing 62. Cylinder manifold 68 further has a plurality of apertures 72 for receiving bolts 20 when the apparatus is assembled; a plurality of anode assembly receiving apertures 76, each aperture including nozzle portion 77 at an outside end thereof and further including a stabilization slot near its inner end 78 as best seen in FIG. 3; and alignment pin 79. Insulated cylinder manifold bearing 62 has aperture 64 therein for mounting bearing 62 and cylinder manifold 68 to shaft 52, the engaging surfaces being profiled to cooperate with each other and profiled shaft 52. Flange 12, stock drive index plate 22, nozzle and socket index plate 40, cylinder manifold 68 and shaft 52 are similar to corresponding parts in the prior art patents. Detailed descriptions will not be included herein.

Figure 4:
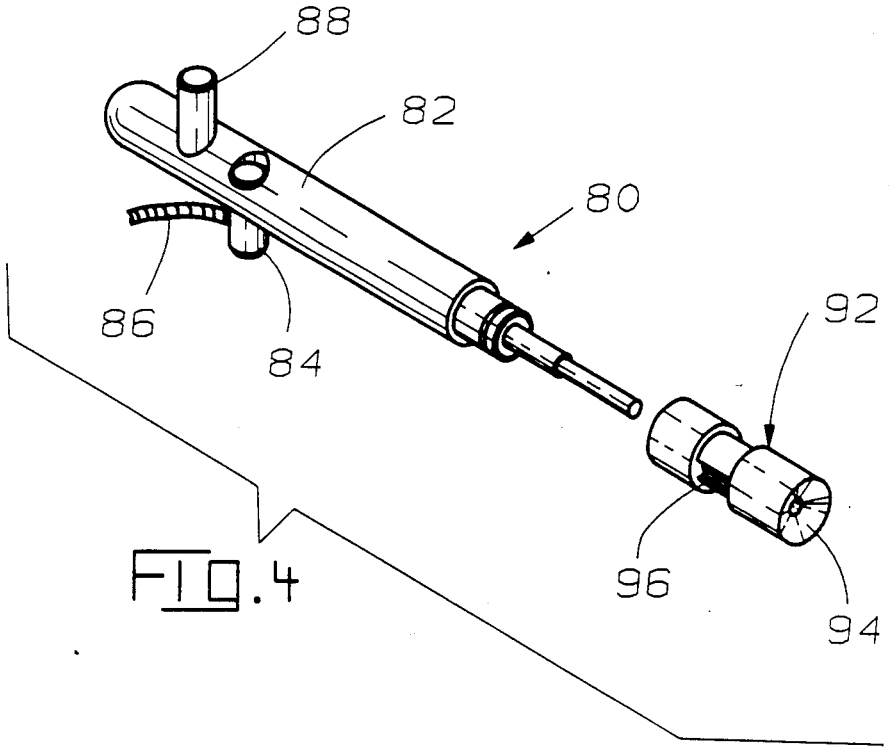
FIG. 4 is a perspective view of the anode assembly of the apparatus as shown in FIG. 1.

Referring now to FIGS. 3 and 4, anode assemblies 80 are comprised of conductive body 82 having a radially projecting conductive stabilization pin 84 in which is secured one end of conductive member 86. Conductive body 82 further has a radially projecting retraction pin 88, extending in the opposite direction as stabilization pin 84. Conductive body member 82 has an anode member (not shown) and dielectric shroud 92 extending forwardly from said body and surrounding said anode member. Shroud 92 further has nozzle apertures 96 which receive electrolytic solution during plating. The front face of shroud 92 has a lead-in surface 94 for guiding terminal members 170 into alignment and engagement with the anode member. The details of anode assembly 80 are given in copending U.S. patent application Ser. No. 946,401 entitled *Anode Assembly for Selectively Plating Electrical Terminals* and previously incorporated by reference herein.

Stock drive index plate 22 further has V notches 26 for stock which align strip 170 of terminals 172 along a portion of the circumference of assembled apparatus 10. Nozzle and socket index plate 40 has a plurality of notches 46 for receiving the socket portions of terminals 172 and aligning them with corresponding anode assemblies 80 in assembled apparatus 10. The peripheral surfaces of the flange 12, index ring 22 and nozzle and socket index plate 40 comprise the surface 43 against which the strip 170 of terminals 172 is disposed during the plating operation as is best seen in FIG. 5.

Referring again to FIGS. 1 and 3, wire collar 102 and wire collar cover 110 are mounted to the exterior surface of cylinder manifold 68 proximate its front face 69 such that apertures 106 in the wire collar 102 are aligned with anode assembly receiving apertures 76 and in particular stabilization slots 78 in cylinder manifold 68 but exterior thereto, as will be explained more fully below.

Stationary conductive portion 119 is comprised of cam base metal plate 120 having aperture 126 therein for mounting to shaft 52 and a plurality of apertures 128 therein for receiving bolts 130 in assembling apparatus 10. Cam base plate 120 is preferably undercut at 121 to reduce both weight of the apparatus and friction between stationary plate 120 and rotating cylinder manifold 68. Cam base plate 120 is attached by bolts 130 to collar member 152. Cam base plate 120 also has camming surface 122 along its circumference and an annular extension on surface 123 for receiving cam plate cover 132 in the assembled unit as best seen in FIG. 3. Cam plate cover 132 has aperture 134 for receiving cam base plate 120, a plurality of bolt apertures 135 for use in mounting cam plate cover 132 to cam base plate 120 and a camming surface 140 along its circumference which cooperates with the camming surface 122 to provide a camming track 126 as best seen in FIG. 6, to move anode assemblies 80 into and out of engagement with terminal members 172.

The camming track surfaces are disposed about the circumference of plate 120 and cover 132. The surface extends axially forwardly from cam base plate 120 and axially rearwardly from cam cover 132. In assembled apparatus 10, anode assemblies 80 rotate in cylinder manifold 68. The rearward end of anode assemblies 80 extend axially rearwardly from rotating section 11 and retraction pin 88 rides in camming track 126.

Figure 6:
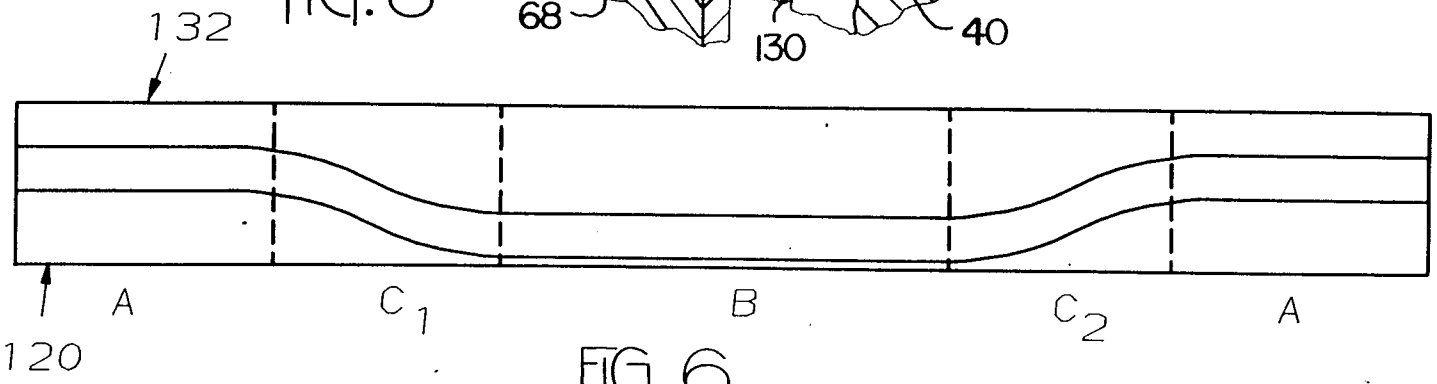
FIG. 6 is a mapping of the camming track along the circumferential surfaces of the conductive portion of the mandrel.

The camming mechanism is more clearly understood by referring to FIG. 6, which shows a mapping of camming track 126 along the circumferential surfaces of cam base plate 120 and cam cover 132. Track 126 is formed by attaching cam cover 132 to base plate 120 by means of bolts 138 as shown in FIG. 3. To illustrate the operation of tract 126, the circumferential surface of plate 120 and cover 132 have been cut along line 6—6 of FIG. 3 and opened flat. Track 126 is shown from right to left to progress from a fully retracted anode member to a fully inserted one to a fully retracted anode member. The sinuous surface is defined by two straight segments A, B each comprising almost half the circumference of the camming track, joined by two short angled transition surfaces $C_1$ and $C_2$ gently fared into said two straight segments to provide a smooth and gentle transition from one segment to the other. In assembled apparatus 10 camming track 126 engages retraction pin 88 of anode assembly 80 such that its anode member is retracted from the terminal position while pin 88 travels along first section A and is fully inserted while pin 88 travels along section B. Anode member moves from full retraction to full insertion while pin 88 is in the two transition sections $C_1$ and $C_2$. The camming system for moving the anode assemblies into engagement with respective terminals 172 allows a greater variance of tolerances between the various pieces. The anode assemblies are not spring loaded but are forced to move by action of the camming track.

In assembling the apparatus the cylinder manifold 68 and cylinder manifold bearing 62 are mounted onto shaft 52 from one direction and nozzle and socket index plate 40, index bearing 36 index ring 22 and flange 12 are mounted from the other. These four main parts are secured together by a plurality of bolts 20 and held securely in place on shaft 52 by the profiled shapes of dielectric members and shaft 52. Wire collar 102 is then attached to cylinder manifold 68. As section 11 rotates, electrolyte passageways 130 in nozzle and socket plate 40 are brought into communication with manifold 56 of shaft 52 thereby permitting plating solution to be pumped through passageways 130, into electrolyte aperture 96 of anode assembly 80 into nozzle openings, over the anode member, and into terminal 172. Conductive shaft 52 has a mounting means for mounting the shaft in stationary position on support surface 182 such as a plating tank shown in FIG. 2.

After the dielectric members have been mounted to the shaft the cam base plate 120 is joined to the collar 152 by bolts 130 and the unit is attached to shaft 52 by washer and nuts 160, 162. Collar 152 and cam base plate 120 are retained in proper alignment by set screw 156 which is spring loaded and engaged in keying slot 58 of shaft 52.

Anode assemblies 80 are then inserted into cylinder manifold 68 and extend over the nozzle plate such that electrolyte apertures 96 in anode assembly 80 are in alignment with electrolyte passageways 130 of the apparatus. In the assembled condition, retraction pins 88 of assembly 80 lie along camming track 126 as previously described and stabilization pins 84 lie in respective stabilization slots 78 of cylinder manifold 68. As is shown in FIG. 3, the other end of the wire conductor 86 from anode assembly 80 is then inserted into termination section 106 of the wire collar member 102 and attached with a set screw 108. Wire collar cover 110 is then attached to the unit to protect wire conductors 86 on anode assemblies 80 from being damaged during the plating process. The final portion of the assembly, the cam plate cover 132 is then attached to the cam base plate 120 thus encapturing the anode assemblies 80.

As best seen in FIG. 2, one or more spring tab members 144 are attached by bolt 148 to cam plate cover 132 in assembled apparatus 10 to provide a conductive path through spring tabs 146 from cam plate cover 132 to wire collar cover 110, thus assuring electrical connection for each anode assembly and assuring that a uniform current will be present in each one of the plating cells of apparatus 10.

Figure 7:
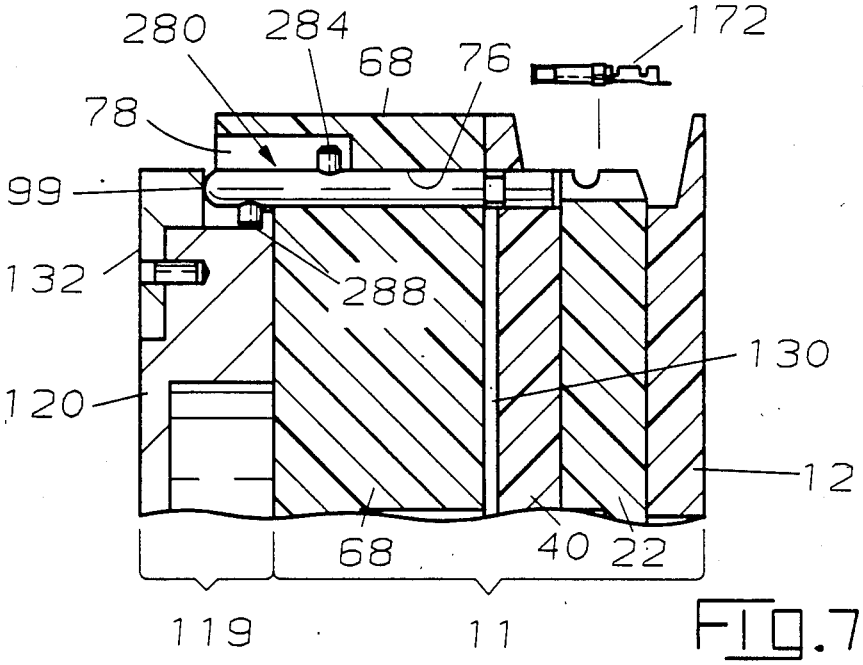
FIG. 7 is a fragmentary view of an alternative embodiment of the invention.

FIG. 7 shows an alternative embodiment 210 of the apparatus, which includes the camming mechanism as previously described but eliminates the wire collar member 102 and wire cover 10 and wire on anode assemblies. Anode assemblies 280 are moved into place by the action of the cam plate cover 132 and the interrelation between the cam plate cover 132 and the cam base plate 120. Electrical engagement between the end of anode assembly 280 and cam cover 132 at 99 provides electrical contact between the two surfaces.

In operation driving means, not shown, rotates the apparatus 10 and strip 170 is fed onto the apparatus 10. Electrolyte solution is supplied under pressure into the conduit 56 of shaft 52. An electrical potential from source E (not shown) is applied between the cam base plate 120 and strip fed terminals 172 to produce a current I. Terminals 172 serve as cathodes onto which noble or precious or semiprecious metal ions of the electrolyte solution are to be plated. Upon rotation of apparatus 10 each of the electrolyte passageways 130 communicated with the electrolyte manifold 58. The electrolyte flows from conduit 56 through passageway 130, through nozzle aperture 96 into nozzle and over the anode members of anode assemblies 80 which lie within the interior passageway of terminal members 170. The electrolyte wets the terminal interior and the anode members. Sufficient ion density and current density are present for the ions to deposit as plating upon the surfaces of the interior of the terminal. The proximity of the anode members to the contact surfaces to ensure that the surfaces of the terminal interiors are plated rather than other terminal surfaces. Excess electrolyte will flow past anode members and will be returned to the plating bath. As the apparatus is further rotated passageways and corresponding nozzles successively become disconnected from alignment with manifold 58, retraction pin 88 of anode assemblies 80 moves along cam track 126 to pull the anode member out of terminal 172 and plating deposition ceases.

The invention further has means for easily loading terminal strips 170 owing to cam retract rod 60 and spring 61 mounted within shaft 52. When rod 60 is activated by drive means (not shown), conductive portion containing cam assembly is moved forward on shaft 52 so that all of anode assemblies 80 are disengaged from terminal area 43. This permits terminal strip 170 to be loaded onto surface 43 without interference from anode assemblies. After the strip is loaded, rod 60 is again activated to engage the cam assembly and anode assemblies 80 into their respective positions. As conductive portion 119 is moved, screw moves along keying slot 58 to maintain alignment of dielectric and conductive portions 11 and 119 respectively. In the presently preferred embodiment, cam retract rod 60 is operated pneumatically. It is to be understood that other means may be used.

Generally, the anode member is a platinum wire, which along with stainless steel body member 82 will last indefinitely. Dielectric shrouds 92, however, are subject to wear, particularly where terminals enter the shroud passageway. Each shroud 92 will last about one hundred thousand insertions before needing to be replaced.

Furthermore, the design of assembly 10 permits easy set up and replacement of anode assemblies 80 as they wear. Dielectric shroud members 92 can be easily replaced when they begin to show wear. It, therefore, is more cost effective to replace shroud members 92 at regular intervals to assure that plating will be accurately deposited in terminals and that apparatus 10 will function effectively.

Apparatus 10 has advantages over the assemblies of the prior art, in that it has fewer parts, easy access to replacability of the anodes, and more reliable alignment of the anodes in the terminals by use of the anode assembly as shown in the preferred embodiment.

The stabilization pins as well as providing a connecting area for the conductive wire keep the cylindrical body members from rotating in position so that they will remain in alignment. It is preferable that the material for the shroud and dielectric pins be injection moldable and/or extrudable. In addition, the material should be thermally stable and acid resistant. One such material is Delrin, an acetyl resin available from E. I. DuPont de Nemours & Company.

The invention has been described by way of examples only. It is to be understood that other types of socket terminals may be plated in accordance with the invention. Dimensional changes in the strip of terminals such as center line spacing of the terminals, the width of strip of terminals and location of the contact surface within the terminal can be accommodated easily by corresponding dimensional changes in the spacing and arrangement of the anode assemblies and indexing wheels.

It is thought that the plating apparatus of the present invention and many of its attendant advantages will be understood from the foregoing description. Changes may be made in the form, construction and arrangement of parts thereof without departing from the spirit and scope of the invention or sacrificing all of its material advantages.

We claim:

1. An apparatus for plating interior surfaces of electrical terminals that are spaced apart and attached to a carrier strip, that is utilized to strip feed the terminals, comprising:

a mandrel having first and second portions, said first portion being dielectric and mounted for rotation on a stationary conductive shaft as strip fed terminals are continuously fed to said first portion, wrapped against said first portion and exited therefrom, said first portion including a plurality of nozzles distributed about its axis of rotation, said second portion being conductive and mounted in a stationary position on said shaft;

a plurality of anode members mounted within said nozzles, said anode members being movable into and out of the interiors of the terminals that are against said first mandrel portion;

a conduit supplying plating solution under pressure through said nozzles and upon said anode members;

a source of electrical potential for supplying electrical current flow from said anode members, through said plating solution and into the interiors of said terminals, thus forming a plurality of plating cells about said first mandrel portion; and means for providing an essentially uniform current to each of said plating cells, comprising a conductor member having one end electrically engaged and mechanically secured to a conductive portion of said anode member, a conductive member secured circumferentially around a forward portion of said dielectric first mandrel portion proximate said conductive second mandrel portion, said conductive member including a plurality of conductor member terminating apertures in which are disposed the other end of said conductor members, and means for electrically coupling said conductive second mandrel portion with said conductive member such that said conductive member may rotate while remaining in electrical engagement with said conductive second mandrel portion.

2. The apparatus for plating interior surfaces of electrical terminals as described in claim 1, wherein said conductive second mandrel portion further includes camming means for moving said anode members into and out of the interiors of said terminals.

3. The apparatus for plating interior surfaces of electrical terminals as described in claim 2 wherein said camming means includes a camming track which cooperates with a camming engagement member on each said anode member, said camming engagement members being moved along said camming track as the anode members disposed in said dielectric mandrel portion are rotated around said shaft.

4. An apparatus for plating interior surfaces of electrical terminals as described in claim 3 wherein said camming track is a sinuous surface defined by first and second straight portions, each of which comprises almost half of the circumference of said track, said first straight portion providing for full insertion of almost half said anode members into said terminal and said second straight portion providing for full retraction of almost another half of said anode members from said terminals, said first and second straight portions being joined by first and second relatively short angled transition sections to provide smooth and gentle transition from one straight portion to the other.

5. The apparatus for plating interior surfaces of electrical terminals as described in claim 1 wherein said conductive second mandrel portion includes camming means for moving said anode members into and out of the interiors of said terminals, said camming means including first and second camming plate members, said first camming plate member having an axially forwardly facing camming surface along its circumference which cooperates with a complementary axially rearwardly facing camming surface on said second camming plate member to define a camming track therebetween, said camming track being dimensioned to receive and cooperate with a camming engagement member on each of said anode members to move said anode members into and out of the interiors of said terminals.

6. The apparatus for plating interior surfaces of electrical terminals as described in claim 5 wherein said camming track is sinuous surface defined by first and second straight portions, each of which comprising almost half of the circumference of said track, said first straight portion providing for full insertion of almost half of said anode members into said terminal and said second straight portion providing for full retraction of almost another half of said anode members from said terminals, said first and second straight portions being joined by first and second relatively short angled transition sections to provide smooth and gentle transition from one straight portion to the other.

7. The apparatus for plating interior surfaces of electrical terminals as described in claim 5 wherein said second camming plate member further includes a flange which extends axially outwardly along the circumference thereof and provides means for retaining said anode members in said dielectric first mandrel portion.

8. The apparatus for plating interior surfaces of electrical terminals as described in claim 7 wherein said flange includes means for electrically coupling said conductive second mandrel portion with said conductive member secured circumferentially around said dielectric first mandrel portion.

9. The apparatus for plating interior surfaces of electrical terminals as described in claim 8 wherein said coupling means comprises at least one conductive spring fingered member mechanically secured to said flange with said spring fingers electrically engaging said conductive member secured to said dielectric mandrel portion.

10. The apparatus for plating interior surfaces of electrical terminals as described in claim 1 wherein said conductive member secured circumferentially around said dielectric first mandrel portion is comprised of first and second sections, said first section including said conductor member terminating apertures and said second section including a first portion for covering a portion of said conductor members and a second portion for engaging said electrically coupling means to provide electrical current from said conductive second mandrel portion to said conductive member.

11. The apparatus for plating interior surfaces of electrical terminals as described in claim 10 wherein said coupling means comprises at least one conductive spring fingered member mechanically secured to said conductive second mandrel portion with said spring fingers in electrical engagement with said second portion of said second section of said conductive member.

12. The apparatus for plating interior surfaces of electrical terminals as described in claim 1 wherein said dielectric first mandrel portion includes stabilization means for preventng rotation of said anode members in said nozzles.

13. An apparatus for plating interior surfaces of electrical terminals that are spaced apart and attached to a carrier strip, that is utilized to strip feed the terminals, comprising:

a mandrel having first and second portions, said first portion being dielectric and mounted for rotation on a stationary conductive shaft as strip fed terminals are continuously fed to said first portion, wrapped against said first portion and exited therefrom, said first portion including a plurality of nozzles distributed about its axis of rotation, said second portion being conductive and mounted in a stationary position on said shaft;

a plurality of anode members mounted within said nozzles, said anode members being movable into and out of the interiors of the terminals that are against said first mandrel portion;

a conduit supplying plating solution under pressure through said nozzles and upon said anode members;

a source of electrical potential for supplying electrical current flow from said anode members, through said plating solution and into the interiors of said terminals, thus forming a plurality of plating cells about said first mandrel portion; and camming means for moving said anode members into and out of the interiors of said terminals, said camming means including a camming track which cooperates with a camming engagement member on each said anode member, said camming engagement members being moved along said camming track as the anode members disposed in said dielectric mandrel portion are rotated around said shaft.

14. The apparatus for plating interior surfaces of electrical terminals as described in claim 13 wherein said camming track is a sinuous surface defined by first and second straight portions each comprises almost half of the circumference of said track, said first straight portion providing for full insertion of almost half of said anode members into said terminal and said second straight portion providing for full retraction of almost another half of said anode members from said terminals, said first and second straight portions being joined by first and second relatively short angled transition sections to provide smooth and gentle transition from one straight portion to the other.

15. The apparatus for plating interior surfaces of electrical terminals as described in claim 14 further including means for providing an essentially uniform current to each of said plating cells, comprising a conductor member having one end electrically engaged and mechanically secured to a conductive portion of said anode member, a conductive member secured circumferentially around a forward portion of said dielectric first mandrel portion proximate said conductive second mandrel portion, said conductive member including a plurality of conductor member terminating apertures in which are disposed the other end of said conductor members, and means for electrically coupling said conductive second mandrel portion with said conductive member such that said conductive member may rotate while remaining in electrical engagement with said conductive second mandrel portion.

16. The apparatus for plating interior surfaces of electrical terminals as described in claim 15 wherein said conductive member secured circumferentially around said dielectric first mandrel portion is comprised of first and second sections, said first section including said conductor member terminating apertures and said second section including a first portion for covering a portion of said conductor members and a second portion for engaging said electrically coupling means to provide electrical current from said conductive second mandrel portion to said conductive member.

17. The apparatus for plating interior surfaces of electrical terminals as described in claim 16 wherein said coupling means comprises at least one conductive spring fingered member mechanically secured to said conductive second mandrel portion with said spring fingers in electrical engagement with said second portion of said second section of said conductive member.

18. The apparatus for plating interior surfaces of electrical terminals as described in claim 13 wherein said dielectric first mandrel portion includes stabilization means for preventing rotation of said anode members in said nozzles.

* * * * *